United States Patent [19]

Plummer

[11] Patent Number: 4,707,264

[45] Date of Patent: Nov. 17, 1987

[54] WATER EXTRACTION FROM HYDROCARBONS IN THE PRESENCE OF ASPHALTIC PRECIPITATES

[75] Inventor: Mark A. Plummer, Littleton, Colo.

[73] Assignee: Marathon Oil Company, Findlay, Ohio

[21] Appl. No.: 856,744

[22] Filed: Apr. 28, 1986

[51] Int. Cl.[4] ..... B01D 11/00

[52] U.S. Cl. ..... 210/634; 210/511

[58] Field of Search ..... 166/304; 208/45; 210/634, 511

[56] References Cited

U.S. PATENT DOCUMENTS

| | | | |
|---|---|---|---|
| 3,321,394 | 5/1967 | Mills | 208/45 |
| 3,830,737 | 8/1974 | Friedman et al. | 252/8.55 B |
| 3,915,132 | 10/1975 | Sutton | 134/40 |
| 3,948,324 | 4/1976 | Lybarger | 166/307 |
| 3,970,148 | 7/1976 | Jones et al. | 166/307 |
| 4,207,193 | 6/1980 | Ford et al. | 252/8.55 B |
| 4,414,035 | 11/1983 | Newberry et al. | 134/3 |
| 4,454,918 | 6/1984 | Richardson et al. | 166/303 |

*Primary Examiner*—Frank Spear

*Attorney, Agent, or Firm*—Jack L. Hummel; Rodney F. Brown

[57] ABSTRACT

A process for solubilizing asphaltic precipitates when extracting water from a hydrocarbon stream with a glycol-water stream by adding a solvent comprised of a bulk aromatic hydrocarbon and an oil-soluble alcohol dispersant to the hydrocarbon stream.

17 Claims, No Drawings

WATER EXTRACTION FROM HYDROCARBONS IN THE PRESENCE OF ASPHALTIC PRECIPITATES

BACKGROUND OF THE INVENTION

Technical Field

The invention relates to a process for extracting water from a liquid hydrocarbon and more particularly to a process for extracting water from a liquid hydrocarbon while solubilizing asphaltic precipitates in the liquid hydrocarbon.

Related Art

Crude oil produced at the wellhead under high pressure is flashed in a depressurization vessel. A vapor stream comprised of low molecular weight paraffinic hydrocarbon and water is taken off the top of the depressurization vessel. The vaporous hydrocarbon-water stream is condensed by compression and cooling. A solution of glycol and water is added to the resulting liquid hydrocarbon-water stream to extract the water therefrom. The composition is fed to a gravity separator where a water-free liquid hydrocarbon stream is taken off the top and a water-enriched glycol-water stream is taken off the bottom. The glycol-water stream is processed to remove a portion of the water and the remainder of the stream is recycled to the liquid hydrocarbon-water stream for continued use as a water extractant.

Substantial quantities of asphaltic precipitates are entrained in the hydrocarbon-water stream in the vapor state coming off the depressurization vessel. The asphaltic precipitates drop out of the hydrocarbon-water stream when it is condensed and contacted with the glycol-water stream since the asphaltic precipitates are insoluble in both the hydrocarbon-water and the glycol-water streams. The asphaltic precipitates accumulate continuously in the separator at the interface between the hydrocarbon and glycol-water phases. Eventually, the accumulated asphaltic precipitates must be removed by mechanical means which requires periodic plant shutdown.

A need exists for a process of extracting water from the low molecular weight paraffinic hydrocarbons without accumulating asphaltic precipitates in the process equipment. A number of asphaltene solvents are known in the art for dissolving asphaltenes accumulating in oil production wells and related equipment. U.S. Pat. Nos. 3,830,737 to Friedman et al; 3,914,132 to Sutton; 3,948,324 to Lybarger; 3,970,148 to Jones et al; 4,207,193 to Ford et al; 4,414,035 to Newberry et al; and 4,454,918 to Richardson et al all disclose the use of hydrocarbon-type solvents to dissolve asphaltenes in and around oil wells. However, none of the above-cited references relate to preventing the accumulation of asphaltic precipitates in an above-ground process for extracting water from low molecular weight paraffinic hydrocarbons. Such a process makes specific demands on an asphaltic precipitate solvent which are not encountered during production of oil. Particularly the combined presence of a glycol-water stream and a hydrocarbon-water stream creates a need for an asphaltic precipitate solvent which performs compatibly with all the components of the streams.

SUMMARY OF THE INVENTION

The present invention relates to a process for extracting water from a liquid hydrocarbon with a glycol-water stream while simultaneously preventing the accumulation of asphaltic precipitates in the related process equipment. The liquid hydrocarbon-water stream is obtained by flashing a crude oil and condensing the resulting vapor. The liquid hydrocarbon-water stream is advantageously comprised of paraffinic hydrocarbons having molecular weights below about 300. An asphaltic precipitate solvent is added to the light hydrocarbon-water stream. The asphaltic precipitate solvent is comprised of two components, an aromatic hydrocarbon in which asphaltic precipitates are soluble and an alcohol dispersant which is substantially oil-soluble.

The asphaltic precipitate solvent solubilizes the asphaltic precipitate and maintains it in solution in the liquid hydrocarbon-water stream. The stream is then contacted with a glycol-water stream to extract the water therefrom. A water-free hydrocarbon stream containing the solvent and dissolved asphaltic precipitate is recovered from the hydrocarbon/glycol-water separator. The remainder of the separator product is a water-enriched glycol-water stream containing little or no asphaltic precipitates or solvent.

The asphaltic precipitate solvent of the present invention is particularly advantageous because the amount of solvent required relative to the amount of hydrocarbon processed is small. The presence of the solvent does not substantially hinder operation of the water extraction process from the hydrocarbon, yet obviates the need for periodic shutdown of the plant to remove asphaltic precipitates. The process is suitably incorporated into newly constructed process equipment or is equally beneficial as a retrofit for existing process equipment. Retrofitting provides a low-cost remedial solution to the problem of asphaltic precipitate buildup in an existing water extraction system.

DESCRIPTION OF PREFERRED EMBODIMENT

As used herein, the term "asphaltic precipitates" refers to solid or semi-solid hydrocarbon components including asphaltenes, malthenes, carbenes and oils. The asphaltic precipitate solvent employed in the present invention is comprised of a bulk aromatic hydrocarbon and an oil-soluble alcohol dispersant. The bulk aromatic hydrocarbon may be, for example, xylene, toluene, or mixtures of aromatic hydrocarbons. The preferred bulk aromatic hydrocarbon is xylene. The weight ratio of solvent to asphaltic precipitates necessary to maintain the precipitates in solution in the hydrocarbon-water phase is in the range of 1 to about 25 weight of solvent to weight of precipitates, preferably about 2 to about 10, and most preferably about 6 to about 8.

The dispersant is an oil-soluble alcohol which is relatively more soluble in the hydrocarbon-water and water-free hydrocarbon streams than in the glycol-water stream. The concentration of alcohol in the solvent should be at or below about 20% by weight based on the total weight of the solvent. If the concentration goes above this value the alcohol dispersant unacceptably increases the phase separation time of the hydrocarbon and glycol-water streams beyond tolerable limits. However, within the specified concentration range the presence of alcohol does not substantially impact the separation time of the streams. The concentration of alcohol in the solvent is preferably about 2.0 to about 10% by weight. The most preferred weight concentration of alcohol in the solvent is around 5% by weight.

Alcohols useful herein include those having molecular weights from pentanol (i.e., amyl alcohol) to octanol and preferably from hexanol to octanol. The alcohol may be a mixture of any of these alcohols within the stated molecular weight range. The oil-soluble alcohol should be substantially free of any water-soluble components such as butanol or lower molecular weight alcohols.

Because the oil-soluble alcohol is relatively more soluble in the hydrocarbon streams than the glycol-water stream, substantially all of the solvent, including the alcohol, and dissolved asphaltic precipitates, remains in the water-free hydrocarbon product stream recovered from the hydrocarbon/glycol-water separator and can be used as hydrocarbon product. Small quantities of residual asphaltic precipitates and solvent found in the glycol-water stream after separation from the hydrocarbon stream can be removed by absorption on activated carbon.

The solvent is preferably added to the hydrocarbon-water stream after condensation of the stream from a vapor to a liquid, but prior to contact with the glycol-water stream. Thereafter, the glycol-water stream is added to the hydrocarbon-water stream at a contact temperature of about 5° to 30° C. The weight ratio of glycol to water in the feedstream is advantageously about 75/25 and the weight ratio of the water-enriched glycol-water stream recovered from the separator is about 60/40.

Although less preferred, the solvent may be added to the water-free hydrocarbon stream after contact with the glycol-water stream. However, this requires the use of more solvent apparently because the solution of glycol and water coats the asphaltic precipitates before contact with the solvent which makes the precipitates more difficult to solubilize into the hydrocarbon stream. Nonetheless, the relative concentration ranges for the components of the process streams stated above are generally applicable to this embodiment as well.

Although it is not known, it is believed that the mechanism for the beneficial result achieved by use of the solvent in the present invention is the ability of the oil-soluble alcohol to disperse and coat the polar asphaltic precipitates. The alcohol dispersant renders the polar asphaltic precipitates soluble in the bulk aromatic hydrocarbon portion of the solvent. The bulk aromatic hydrocarbon portion then dissolves the asphaltic precipitates in the hydrocarbon-water and water-free hydrocarbon streams. The present solvent more readily solubilizes asphaltic precipitates in the hydrocarbon stream than conventional solvents, particularly in the presence of glycol and water.

The following examples demonstrate the advantages of the present invention but are not to be construed as limiting the scope thereof.

EXAMPLE 1

A hydrocarbon/glycol-water separator is simulated by contacting 25 ml of an ethylene glycol-water solution, having a ratio of 65/35 weight ethylene glycol to weight water, with 25 ml of hexane at a temperature of 18° C. 0.5 g of asphaltic precipitate is placed at the interface between the ethylene glycol-water solution and hexane which results in 4 ml of an asphaltic emulsion at the interface when the two phases are mixed.

In the first experiment, a solvent consisting only of xylene in a weight ratio of 9/1 xylene to precipitate is added to the above-described mixture. Total time to separate the hexane and glycol-water phases is 75 seconds with no asphaltic emulsion remaining at the interface.

The same experiment is repeated using a solvent comprising of xylene as a bulk aromatic hydrocarbon and n-pentanol as an oil-soluble alcohol dispersant at a concentration of 5% by weight. The weight ratio of solvent to asphaltic precipitate 6/1. The time required to separate the hexane and glycol-water phases with no emulsion at the interface is 60 seconds.

In both cases, there is substantially no increase in the volume of the glycol-water phase indicating that substantially all the solvent and dissolved asphaltic precipitates enter the hexane phase. Use of an alcohol dispersant in the solvent according to the present invention substantially reduces the required phase separation time below that required for a pure hydrocarbon solvent. Use of the alcohol dispersant also reduces the amount of solvent required to eliminate the emulsion between the hexane and glycol-water phases.

EXAMPLE 2

A series of experimental runs are conducted to determine asphaltic precipitates solution into the hydrocarbon phase as a function of solvent type, concentration and order of addition. A simulated separator mixture is prepared according to Example 1. The order of adding the solvent is varied to simulate two embodiments of the invention. In one case, the solvent is added to the composition after glycol-water phase contact with the hydrocarbon phase. In the second case, the solvent is added before glycol-water phase contact with the hydrocarbon phase. The results are shown in Table 1 below.

TABLE 1

| Weight Ratio of Solvent to Precipitate | % by Weight Undissolved Precipitate in Hydrocarbon Phase | % by Weight n-Pentanol in Solvent | Solvent Added Added Before or After Hydrocarbon-Glycol Contact | Separation Time (min.) |
|---|---|---|---|---|
| 4 | 17.2 | 0 | After | 2.0 |
| 20 | 6.8 | 0 | After | 5+ |
| 4 | 15.1 | 10 | After | 1.0 |
| 6 | 11.0 | 10 | After | 1.5 |
| 10 | 8.9 | 10 | After | 2.0 |
| 20 | 2.3 | 10 | After | 2.0 |
| 4 | 15.1 | 20 | After | 1.0 |
| 20 | 2.7 | 20 | After | 3.0 |
| 6 | 6.6 | 0 | Before | 2.0 |
| 8 | 2.3 | 0 | Before | 2.0 |
| 6 | 2.3 | 10 | Before | 1.0 |
| 7 | 0.0 | 10 | Before | 1.0 |

The results of the table above indicate that solubility of the precipitates in the hydrocarbon is substantially improved using an alcohol dispersant in the solvent. Further the process significantly improves when the solvent is added to the hydrocarbon phase before it is contacted with the glycol-water phase. Decreasingly less solvent is required to solubilize a given amount of precipitate as the alcohol concentration in the solvent increases up to 10% by weight. Increasing the alcohol concentration about 10% by weight does not show any further improvement for this specific asphaltic precipitate.

EXAMPLE 3

The procedure of Example 1 is repeated using different dispersants in the solvent. The concentration of dispersant in the solvent is constant throughout at about 20% by weight in xylene. The solvent is added to the phase mixture in a weight ratio of 20/1 solvent to precipitate throughout. The results are shown in Table 2 below.

TABLE 2

| Dispersant | Separation Time (min.) |
|---|---|
| n-Pentanol | 3.0 |
| Triethanol amine | 15+ |
| Heptanic acid | 15+ |

Conventional organic acids and bases such as heptanic acid and triethanol amine are ineffective solvent components for asphaltic precipitates when employed in the presence of glycol-water stream. Triethanol amine apparently hydrogen bonds with the glycol in the glycol-water phase solubilizing itself and the asphaltic precipitates into that phase. Heptanic acid undergoes an acid-based reaction with the glycol-water phase solubilizing itself and the asphaltic precipitates into that phase. In contrast, n-pentanol effectively solubilizes itself and the asphaltic precipitates into the hydrocarbon phase.

While the foregoing embodiment of the invention has been described and shown, it is understood that the alternatives and modifications, such as those suggested and others, may be made thereto and followed in the scope of the invention.

I claim:

1. A process for solubilizing solid asphaltic precipitates entrained in a water-containing liquid paraffinic hydrocarbon while extracting the water from said liquid paraffinic hydrocarbon, the process comprising:

(a) adding a solvent to said water-containing liquid paraffinic hydrocarbon having said solid asphaltic precipitates entrained therein, said solvent comprising a bulk aromatic hydrocarbon and an alcohol dispersant, wherein said alcohol dispersant has a molecular weight between pentanol and octanol inclusive and is preferentially more soluble in said water-containing liquid paraffinic hydrocarbon than in an aqueous glycol solution;

(b) dissolving said solid asphaltic precipitates with said solvent to form a water-containing liquid hydrocarbon stream, comprising said dissolved asphaltic precipitates, said solvent, and said water-containing liquid paraffinic hydrocarbon;

(c) mixing said water-containing liquid hydrocarbon stream with said aqueous glycol solution to extract the water from said liquid paraffinic hydrocarbon; and (d) separating said mixture into a water-free liquid hydrocarbon stream and a water-enriched aqueous glycol solution, wherein said water-free liquid hydrocarbon stream comprises said liquid paraffinic hydrocarbon substantially free of water, said solvent, and said dissolved asphaltic precipitates and wherein said water-enriched aqueous glycol solution comprises said aqueous glycol solution and the water extracted from said water-containing liquid hydrocarbon stream.

2. The process of claim 1 wherein said alcohol dispersant is preferentially more soluble in said water-free liquid hydrocarbon stream than in said aqueous glycol solution.

3. The process of claim 1 wherein said bulk aromatic hydrocarbon is xylene.

4. The process of claim 1 wherein said solvent is added to said water-containing liquid paraffinic hydrocarbon in a weight ratio of about 1.0 to about 25 of said solvent to said precipitates.

5. The process of claim 4 wherein said solvent is added to said water-containing liquid paraffinic hydrocarbon in said weight ratio of about 2.0 to about 10.

6. The process of claim 1 wherein the concentration of said alcohol dispersant in said solvent is less than or equal to about 20% by weight based on said solvent.

7. The process claim 6 wherein the concentration of said alcohol dispersant in said solvent is about 2.0 to about 10% by weight based on said solvent.

8. The process of claim 1 wherein said glycol in solution is ethylene glycol.

9. The process of claim 1 wherein said liquid paraffinic hydrocarbon has a molecular weight below about 300.

10. A process for solubilizing solid asphaltic precipitates entrained in a water-containing liquid paraffinic hydrocarbon while extracting the water from said liquid paraffinic hydrocarbon, the process comprising:

(a) mixing a water-containing hydrocarbon stream, comprising said solid asphaltic precipitates and said water-containing liquid paraffinic hydrocarbon,- with an aqueous glycol solution to extract the water from said water-containing hydrocarbon stream;

(b) adding a solvent to said mixture, said solvent comprising a bulk aromatic hydrocarbon and an alcohol dispersant, wherein said alcohol dispersant has a molecular weight between pentanol and octanol inclusive and is preferentially more soluble in said water-containing liquid paraffinic hydrocarbon than in said aqueous glycol solution;

(c) dissolving said asphaltic precipitates with said solvent; and (d) separating said mixture into a water-free hydrocarbon stream and a water-enriched aqueous glycol solution, wherein said water-free hydrocarbon stream comprises said liquid paraffinic hydrocarbon substantially free of water, said solvent, and said dissolved asphaltic precipitates and wherein said water-enriched aqueous glycol solution comprises said aqueous glycol solution and the water extracted from said water-containing hydrocarbon stream.

11. The process of claim 10 wherein said bulk aromatic hydrocarbon is xylene.

12. The process of claim 10 wherein said solvent is added to the mixture in a weight ratio of about 1.0 to about 25 of said solvent to said precipitates.

13. The process of claim 12 wherein said solvent is added to the mixture in said weight ratio of about 2.0 to about 10.

14. The process of claim 10 wherein the concentration of said alcohol dispersant in said solvent is less than or equal to about 20% by weight based on said solvent.

15. The process of claim 14 wherein the concentration of said alcohol dispersant in said solvent is about 2.0 to about 10% by weight based on said solvent.

16. The process of claim 10 wherein said glycol in solution is ethylene glycol.

17. The process of claim 10 wherein said liquid paraffinic hydrocarbon has a molecular weight below about 300.

* * * * *

UNITED STATES PATENT AND TRADEMARK OFFICE

CERTIFICATE OF CORRECTION

PATENT NO. : 4,707,264

DATED : November 17, 1987

INVENTOR(S) : Mark A. Plummer

It is certified that error appears in the above-identified patent and that said Letters Patent is hereby corrected as shown below:

| | |
|---|---|
| Col. 3, line 16: | Delete "absorption" and insert --adsorption--. |
| Col. 4, line 4: | Delete "comprising" and insert --comprised--. |
| Col. 4, line 36: | Delete "Added". |
| Col. 4, line 61: | Delete "about" and insert --above--. |
| Col. 6, line 13: | After "process" insert --of--. |
| Col. 6, line 27: | Delete "hydrocarbon,-" and insert --hydrocarbon,--. |
| Col. 6, line 60: | Delete "Claim 14" and insert --Claim 12--. |

Signed and Sealed this

Tenth Day of May, 1988

*Attest:*

DONALD J. QUIGG

*Attesting Officer*

*Commissioner of Patents and Trademarks*